United States Patent [19]

Perrella

[11] 4,187,948

[45] Feb. 12, 1980

[54] PILL-BOX DISPLAY STAND

[76] Inventor: Emilio Perrella, Viale S. Carlo, Segrate, Italy

[21] Appl. No.: 882,355

[22] Filed: Mar. 1, 1978

[30] Foreign Application Priority Data

Mar. 4, 1977 [DE] Fed. Rep. of Germany ..... 7706644

[51] Int. Cl.[2] ..... A47F 7/28

[52] U.S. Cl. ..... 211/71; 248/150; D6/188

[58] Field of Search ..... 211/71, 72, 133, 128, 211/186, 189, 60 R; D6/23, 24, 188; 248/150, 152

[56] References Cited

U.S. PATENT DOCUMENTS

| | | | |
|---|---|---|---|
| D. 206,254 | 11/1966 | Lopiano | D6/188 |
| D. 235,595 | 7/1975 | Dogliotti | D6/188 X |
| D. 239,806 | 5/1976 | Bressickello | D6/24 X |
| 584,811 | 6/1897 | Caldwell | 211/189 X |
| 1,358,406 | 9/1920 | Yuncker | 211/71 |
| 1,601,040 | 9/1926 | Phillips et al. | 211/71 |
| 2,051,093 | 8/1936 | Leigh | 211/72 |
| 3,865,247 | 2/1975 | Neglia | 248/152 X |
| 3,926,314 | 12/1975 | Dogliotti | 248/150 X |

FOREIGN PATENT DOCUMENTS

| | | | |
|---|---|---|---|
| 2153652 | 5/1973 | Fed. Rep. of Germany | 211/189 |

*Primary Examiner*—Roy D. Frazier
*Assistant Examiner*—Robert W. Gibson, Jr.
*Attorney, Agent, or Firm*—Holman & Stern

[57] ABSTRACT

A plural-tier display stand for pill-boxes and like articles is disclosed, which is composed by two stand-halves to be brought together for assembly in a mirror-image-like relationship, i.e. back-to-back. Each stand-half is composed, in its turn, by two uprights to be connected by downward sloping tiers, and each tier has perforations to receive the individual pill-boxes. By providing an upward projecting tab on every second tier beneath every second perforation in a row of the overlying tier, it is possible to display the pill-boxes of each row at staggered levels to facilitate grasping and withdrawal of the boxes.

3 Claims, 4 Drawing Figures

PILL-BOX DISPLAY STAND

This invention relates to a display stand, especially for containers of sweets in the form of pills and the like.

It is an object of the present invention to provide a stand of the kind referred to above, which holds the containers to be displayed for sale marshalled on a plurality of superposedly arranged tiers and readily accessible to the purchasers from two sides, such a stand being easily manufactured with a plastics material by injection-molding or similar procedures and capable of being grasped as a whole with the containers held thereon.

The stand according to the invention is essentially characterized in that it is composed by two like halves which can be connected to one another in a mirror-like way, that is back against back, and in which either half consists of two side posts, from a side of which, the front side, project a few tiers which slope downwards in a roof-like configuration and connect the two side posts to one another, the tiers having an array of perforations placed in side-by-side relationship with respect to each other, the outline of such perforations corresponding essentially to the cross-sectional outline of the pill-boxes to be received therein, whereas the other side (the rear side) of the posts has projections and recesses thereon which come into mutual engagement when the two halves of the stand are brought together in a back-to-back relationship, a half-socket being provided for each half of the stand at the lower end thereof between the two posts, the top tier being provided with an aperture running transversally with respect to the pill-box-receiving perforation-rows, said aperture providing a seizing handle for the stand.

Beneath every second perforation of each sloping tier, a tab is provided which juts upwards from the underlying sloping tier, in order that the pillboxes inserted in the corresponding perforations may peep up slightly above the pill-boxes arranged in the adjoining perforations, the withdrawal of the pill-boxes from their respective receiving perforations being thereby facilitated.

Each of the stand-halves, which is exactly equal to the other half, can be manufactured as a single piece of a plastics material, for example by injection-moulding, and the two halves can conveniently be assembled together by placing the respective back walls into contact, taking care that the homolog projections and recesses of the posts come into mutual correct engagement.

The superposedly arranged, pill-box-receiving tiers of both stand-halves are at the same levels, when the stand is assembled, on both sides of same: the stand, by virtue of the supporting socket placed at its bottom has a satisfactory stability, and can readily be grasped bodily, for example to withdraw it from a packing container, and erected on the display spot.

The stand according to the invention is shown in the accompanying drawings, wherein.

Figure 1:
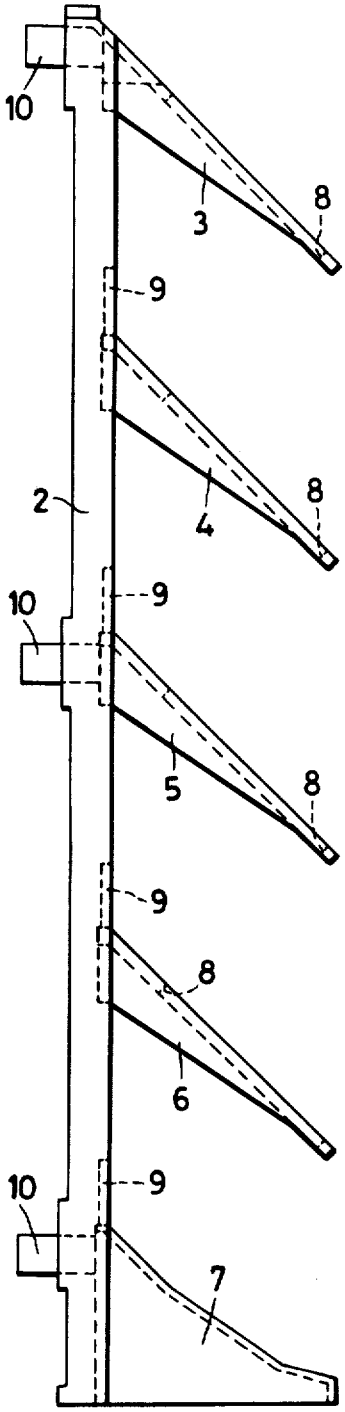
FIG. 1 is a side elevational view of a stand-half.
Figure 2:
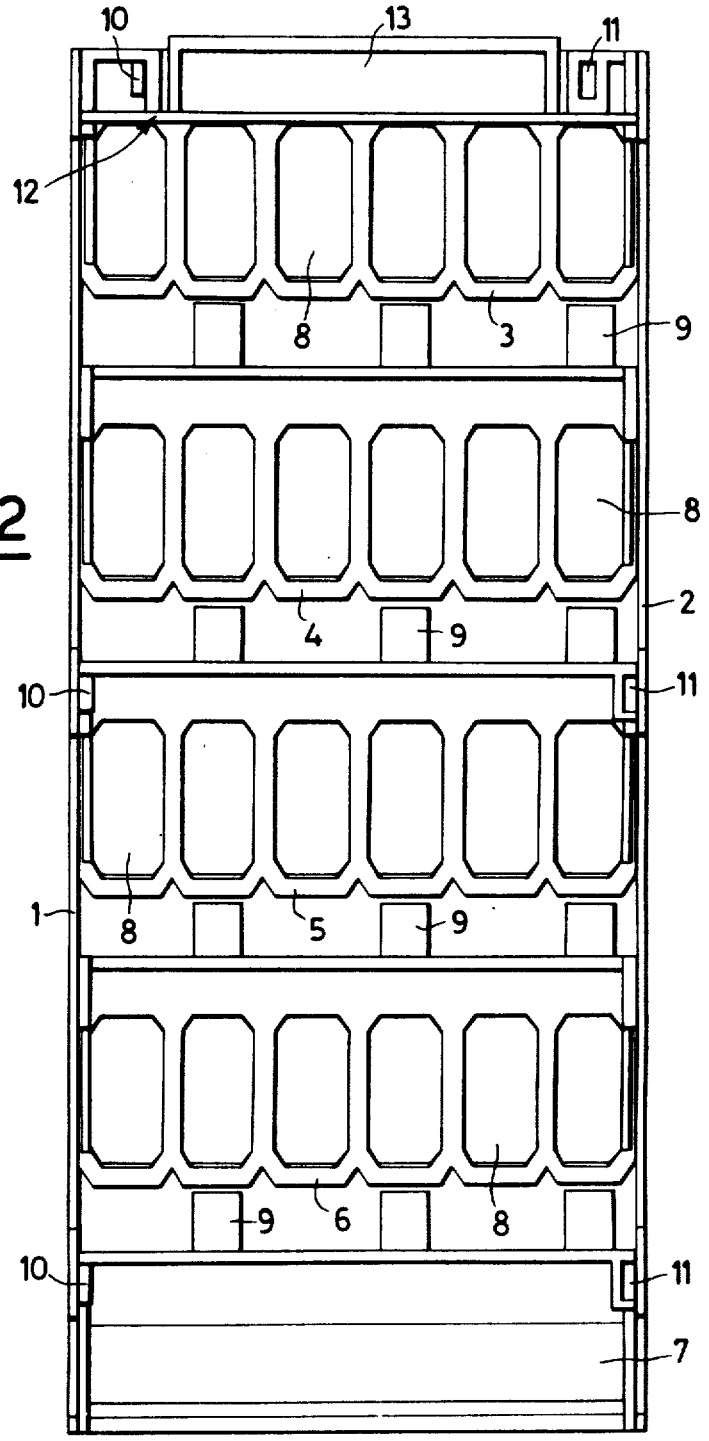
FIG. 2 is a view of the half-stand from the rear.

As can be seen in FIGS. 1 and 2, each stand-half consists of two side posts, 1, 2, between which is arranged a plurality of tiers, 3, 4, 5, 6 which slope downward like the sides of a roof and connect the two side posts to one another, whereas the bottom ends of the two side-posts are connected together by a half-socket 7, the latter having in its top portion, an incline which matches that of the tiers from 3 to 6 inclusive.

Each of the tiers from 3 to 6 inclusive has perforations 8 arranged in side-by-side relationship and the outline of which matches the cross-sectional outline of the containers to inserted therein.

Beneath alternate perforation 8, a tab 9 is provided, which juts from the underlying tier in an upward direction.

The posts 1 and 2 are fitted, on their respective back walls, with projecting studs 10 and matching recesses 11.

Mutually matching projections and recesses are provided, in addition, on a top transversal runner 12 which connects the posts 1 and 2 together.

The topmost tier 3, in addition, is provided with an aperture 13 running along the direction transversal to the perforations 8 and arranged above the top perforation row, said aperture being intended for use as a grasping handle for the whole stand.

As the two stand-halves are brought towards one another in back-to-back relationship, the matching projections 10 of either half come into engagement with the individual recesses 11 of the other stand-half, the two halves being thereby assembled to make up a compact assembly.

Figure 3:
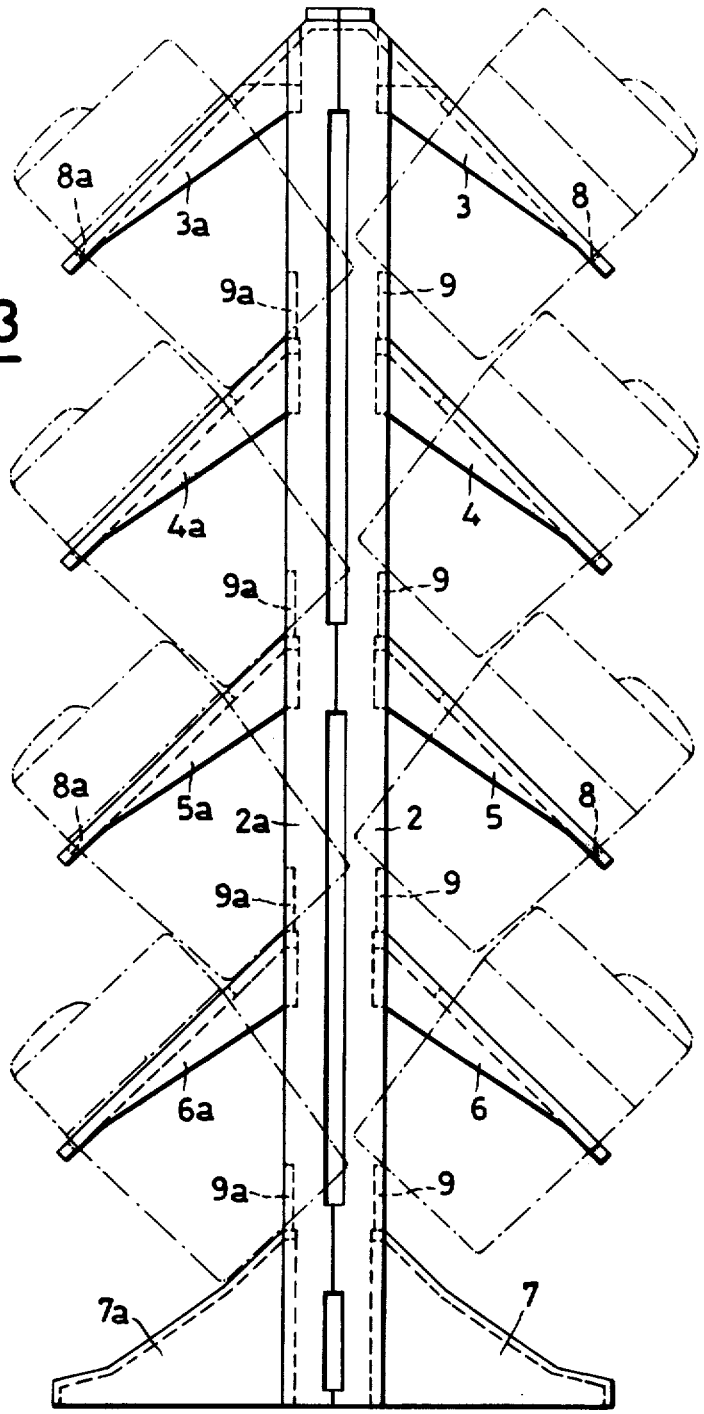
FIG. 3 is a side elevation view of the fully assembled stand.
Figure 4:
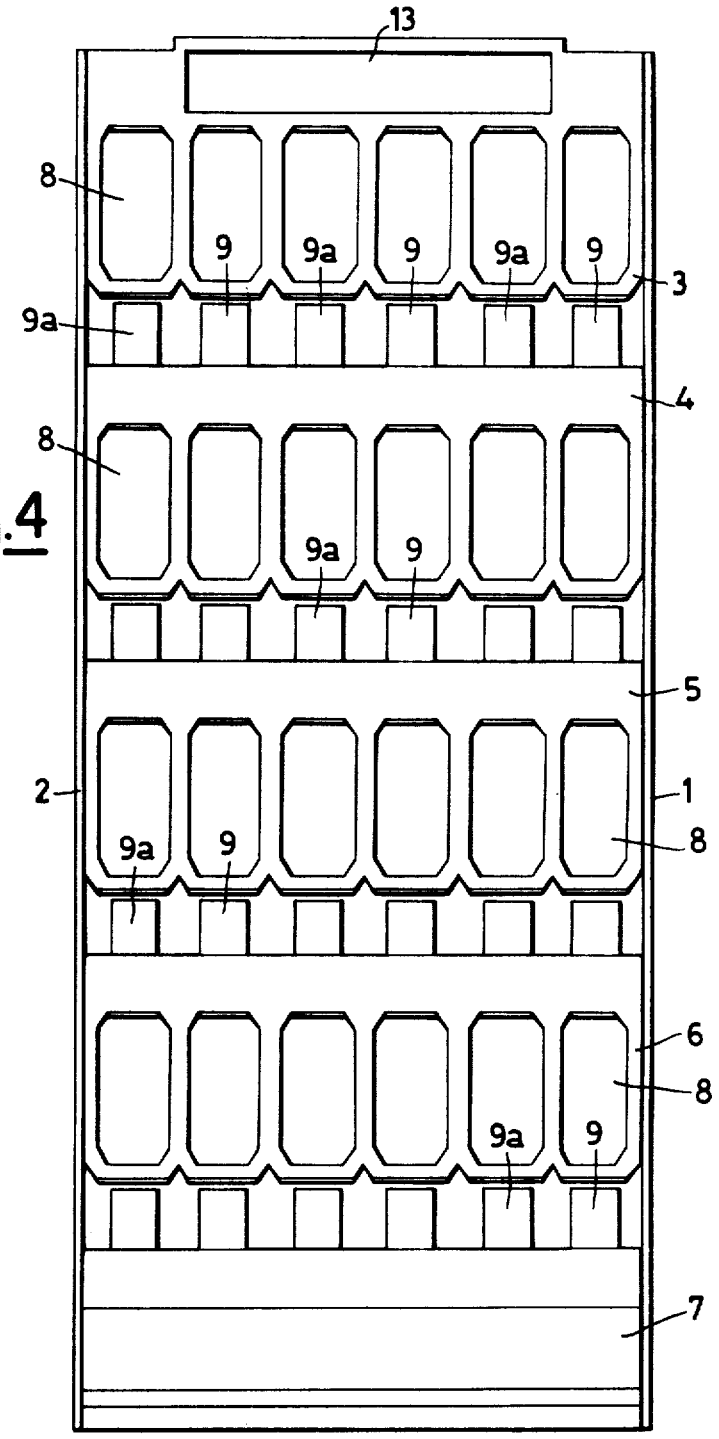
FIG. 4 is a front elevational view of the complete stand.

In FIG. 3 such a configuration is shown in side elevational view and the component parts of either half are connoted by the same reference numerals as of those used for the other half, but with the added character "a".

In this FIGURE of the drawings, the pill-boxes inserted into the individual perforations 8 are shown in phantom, to show how the pill-boxes are alternately resting with their bottom walls either on the underlying tiers (more exactly, on the portion of the tier which has not perforations therethrough), or on the tabs 9 which project upwards from the underlying tier aforesaid.

By so doing, the pill-boxes inserted in their seats are arranged, in alternate sequence on every perforation row, at alternately staggered levels, so that they may unobstructedly and individually be grasped and withdrawn.

The construction of the display stand according to the invention is extremely simple and its assemblage is convenient, above all, on account of the fact that the stand consists of two geometrically similar halves which can easily be brought together.

I claim:

1. A display stand, including two stand-halves for attachment to one another in back-to-back arrangement, said stand-halves each comprising two side posts and of a plurality of superimposed tiers arranged between said side posts and projecting forwardly and downwardly therefrom, each tier having a row of perforations for housing individual articles intended to rest on the underlying tier, said underlying tier being provided with upwardly extending tabs arranged below alternate perforations of the overlying tier to maintain corresponding articles housed in said alternate perforations at a higher level than those housed in the adjacent perforations, the locations of the tabs of one stand-half being alternated with the locations of the tabs of the other stand-half, the rear of the posts of each stand-half having projections and recesses arranged to engage with corresponding recesses and projections of the other stand-half when the two stand-halves are brought together in back-to-back arrangement.

2. A display stand according to claim 1, wherein a half-socket is arranged between the bottom ends of the side posts of each stand-half.

3. A display stand according to claim 1, wherein the topmost tier has an aperture providing a handle.

* * * * *